US008508062B2

(12) United States Patent
Gozdawa

(10) Patent No.: US 8,508,062 B2
(45) Date of Patent: Aug. 13, 2013

(54) TURBOMACHINERY ELECTRIC GENERATOR ARRANGEMENT

(75) Inventor: Richard Julius Gozdawa, Middlesex (GB)

(73) Assignee: Yorlan Holdings Limited, Tortola (VG)

( * ) Notice: Subject to any disclaimer, the term of this patent is extended or adjusted under 35 U.S.C. 154(b) by 0 days.

(21) Appl. No.: 12/726,639

(22) Filed: Mar. 18, 2010

(65) Prior Publication Data

US 2010/0219638 A1 Sep. 2, 2010

Related U.S. Application Data

(63) Continuation of application No. 11/057,582, filed on Feb. 14, 2005, now Pat. No. 7,683,497.

(30) Foreign Application Priority Data

Feb. 14, 2004 (GB) ..... 0403302.3

(51) Int. Cl.
*F01D 5/08* (2006.01)

(52) U.S. Cl.
USPC ..... 290/52; 415/107

(58) Field of Classification Search
None
See application file for complete search history.

(56) References Cited

U.S. PATENT DOCUMENTS

| | | | | |
|---|---|---|---|---|
| 4,156,342 | A | 5/1979 | Korta et al. | |
| 4,253,031 | A * | 2/1981 | Frister | 290/52 |
| 5,087,176 | A | 2/1992 | Wieland | |
| 5,497,615 | A * | 3/1996 | Noe et al. | 60/39.511 |
| 5,564,896 | A * | 10/1996 | Beeck et al. | 415/175 |
| 5,795,138 | A * | 8/1998 | Gozdawa | 417/243 |
| 5,827,040 | A * | 10/1998 | Bosley et al. | 415/106 |
| 5,855,112 | A * | 1/1999 | Bannai et al. | 60/39.511 |
| 6,234,746 | B1 * | 5/2001 | Schroder et al. | 415/115 |
| 6,296,441 | B1 * | 10/2001 | Gozdawa | 415/180 |
| 6,390,789 | B1 * | 5/2002 | Grob et al. | 417/350 |
| 6,622,490 | B2 * | 9/2003 | Ingistov | 60/782 |
| 6,900,553 | B2 | 5/2005 | Gozdawa | |
| 7,112,036 | B2 * | 9/2006 | Lubell et al. | 415/104 |
| 7,140,848 | B2 * | 11/2006 | Jaisle | 417/407 |
| 2002/0089248 | A1 | 7/2002 | Gozdawa | |
| 2002/0095939 | A1 * | 7/2002 | Gordon et al. | 60/784 |
| 2007/0240416 | A1 * | 10/2007 | Ullyott | 60/624 |

FOREIGN PATENT DOCUMENTS

| | | | |
|---|---|---|---|
| GB | 1523640 | A | 9/1978 |
| JP | 02084037 | A | 3/1990 |
| WO | WO02/090721 | A1 | 11/2002 |

* cited by examiner

*Primary Examiner* — Michael Zarroli
(74) *Attorney, Agent, or Firm* — Kirschstein, et al.

(57) ABSTRACT

A turbomachinery electric generator arrangement includes a rotary compressor, a generator having a rotary armature and a stator, a combustion chamber to which compressed gas is directed from the compressor, a rotary turbine to which combustion product is directed from the combustion chamber and a bearing arrangement supporting in rotation the rotary compressor, rotary armature and rotary turbine. Compressed gas for cooling components of the arrangement is directed from the rotary compressor, typically being tapped off from a subsidiary gas output upstream of a primary gas outlet. Bearing thermal shielding and modular construction of components are also features of the arrangement.

6 Claims, 12 Drawing Sheets

TURBOMACHINERY ELECTRIC GENERATOR ARRANGEMENT

CROSS-REFERENCE TO RELATED APPLICATIONS

This application is a continuation of U.S. patent application Ser. No. 11/057,582, filed Feb. 14, 2005, scheduled to issue as U.S. Pat. No. 7,683,497, on Mar. 23, 2010, which claims priority from British Application No. 0403302.3, filed Feb. 14, 2004, both of which are hereby incorporated herein by reference in their entireties.

BACKGROUND OF THE INVENTION

1. Field of the Invention

The present invention relates to a turbomachinery electric generator arrangement.

2. State of the Art

The protection of temperature sensitive components such as bearings from the heat flowing from the turbine, and from heat generated in the generator, are problems in the design of known turbomachinery electric generators. Removal of heat from the armature of the generator is an important consideration in the reliability and life span of the generator.

Although ideally no eddy currents are induced in the armature of the generator they are induced by unavoidable residual harmonics in the rotating field in which the armature rotates synchronously. To keep the temperature of the armature below the upper limit that can be tolerated, adequate means have to be provided for removing the heat generated by the eddy currents, and indeed for removing the heat generated in the air gap by the rotation of the armature in the bore of its stator. Furthermore, the turbine operates at a high temperature and proximate components in the vicinity of the turbine such as a proximate bearing have to be kept cool by controlling the heat flowing from the turbine.

SUMMARY OF THE INVENTION

An improved arrangement has now been devised.

According to a first aspect, the present invention provides a turbomachinery electric generator arrangement comprising:

- a rotary compressor;
- a generator arrangement having a rotary armature and a stator;
- a combustion chamber to which compressed gas is directed from the compressor;
- a rotary turbine to which combustion product is directed from the combustion chamber;
- a bearing arrangement supporting in rotation the rotary compressor, rotary armature and rotary turbine;
- wherein compressed gas for cooling components of the arrangement is directed from the rotary compressor.

It is preferred that the compressor has a primary compressed gas output for directing air to the combustion chamber and a subsidiary gas output for tapping off cooling gas. Beneficially, the subsidiary gas output is upstream of the primary gas outlet. The compressed gas for cooling tapped off from the compressor is therefor preferably at a tap off pressure lower than the primary gas output from the compressor directed to the combustion chamber.

Advantageously, the compressor comprises a radial flow impeller. The turbine beneficially comprises a radial inflow, axial outflow, impeller.

The compressor and the turbine are preferably provided at spaced portions of the arrangement. The generator arrangement is preferably provided intermediate the compressor and the turbine. It is preferred that the compressor and the turbine are overhung at opposed ends of the rotor of the arrangement.

It is preferred that the compressed cooling gas tapped off from the compressor is directed to cool the bearing arrangement. The bearing arrangement beneficially comprises a compressor proximal bearing and a turbine proximal bearing, the cooling gas tapped off from the compressor being advantageously directed to cool both the compressor proximal and turbine proximal bearings.

In one embodiment, the cooling gas tapped off from the compressor is directed along a manifold arrangement to cool both the compressor proximal and turbine proximal bearings. In one embodiment the manifold arrangement has a branch directing cooling gas to the region of the turbine proximal bearing and a branch directing cooling gas to the region of the compressor proximal bearing.

Where the bearing arrangement comprises a compressor proximal bearing and a turbine proximal bearing, the cooling gas tapped off from the compressor may be directed to cool both the compressor proximal and turbine proximal bearings, the cooling gas passing to the turbine proximal bearing prior to passing to the compressor proximal bearing.

Beneficially the cooling gas tapped off from the compressor is directed along a cooling path, which cooling path includes the space between the generator arrangement armature and stator.

Additionally or alternatively the cooling gas tapped off from the compressor is directed along a cooling path, which cooling path includes a portion internally of the armature of the generator.

Beneficially the rotor comprises an internal bore, and cooling gas is directed into and out of the bore. It is preferred that the bore includes an insert to guide the cooling gas to wash the internal bore of the rotor. The insert is preferably of high resistivity material, such as for example stainless steel. In a preferred embodiment the insert may be located in position in the bore of the rotor by a plurality of upstands projecting from the main body of the insert. It is preferred that the insert has a hollow interior.

In one embodiment the generator arrangement includes a plurality of generators, each generator having a respective rotary armature and a stator, the bearing arrangement including a bearing intermediate the generators.

Preferably, the bearing arrangement includes a bearing taking up axial thrust and surge. The bearing arrangement preferably includes a tilting pad bearing. Desirably, the bearing arrangement includes a rolling element bearing arrangement.

It is preferred that the arrangement further includes a shield for thermally protecting a bearing proximate the turbine from the heat of the turbine. It is preferred that the shield comprises a liquid cooled element. The liquid cooled element beneficially includes an internal liquid coolant flowpath. It is preferred that the coolant flowpath extends inwardly towards the rotational axis of the rotor and subsequently outwardly away from the rotational axis of the rotor. The flowpath preferably follows a spiral path. Beneficially the shield is configured as an annular element.

It is preferred that the shield is mounted between the turbine and the turbine proximate bearing. Beneficially the shield is mounted against the backing plate of the turbine, preferably separated from the backing plate by an air gap.

According to a further aspect, the present invention provides a turbomachinery electric generator arrangement comprising:

a compressor having an impeller;

a generator arrangement having a rotary armature and a stator;

a combustion chamber to which compressed gas is directed from the compressor;

a turbine having an impeller, combustion product being directed to the turbine from the combustion chamber;

a bearing arrangement supporting in rotation the impeller of the compressor, the armature and the impeller of the turbine, the bearing arrangement including a bearing proximate the turbine; and, a shield for protecting the bearing proximate the turbine from the heat of the turbine.

According to a further aspect, the present invention provides a turbomachinery electric generator arrangement of modular construction comprising:

a compressor module;

a generator module having a rotary armature and a stator; and a turbine module to which combustion product is directed from a combustion chamber.

One or more bearing modules each comprising a bearing spacer module and a bearing housing module, and supporting in rotation the impeller of the compressor, the armature of the generator and the impeller of the turbine.

The compressor module, the bearing spacer module, the bearing housing module, the generator module and the turbine module have common flanges of the same dimensions whereby they may be bolted one to another in a desired combination and sequence. In particular the flange of the bearing housing is preferably sandwiched between respective flanges of the bearing spacer and its adjacent module. The rotating members, the impeller of the compressor, the armature of the generator and the impeller of the turbine have common terminals for the transmission of torque and to maintain them coaxial such as is provided by Hirth couplings and axial tie bolts. The modules are designed so that they may be assembled in the combination and sequence required by each different application with the least internal adjustment. For instance different power outputs will require internal adjustments of the compressor module and of the turbine module, but their flanging remains unchanged.

BRIEF DESCRIPTION OF THE DRAWINGS

The invention will now be further described, in specific embodiments, by way of example only and with reference to the accompanying drawings in which.

DETAILED DESCRIPTION OF THE PREFERRED EMBODIMENTS

Figure 1A:
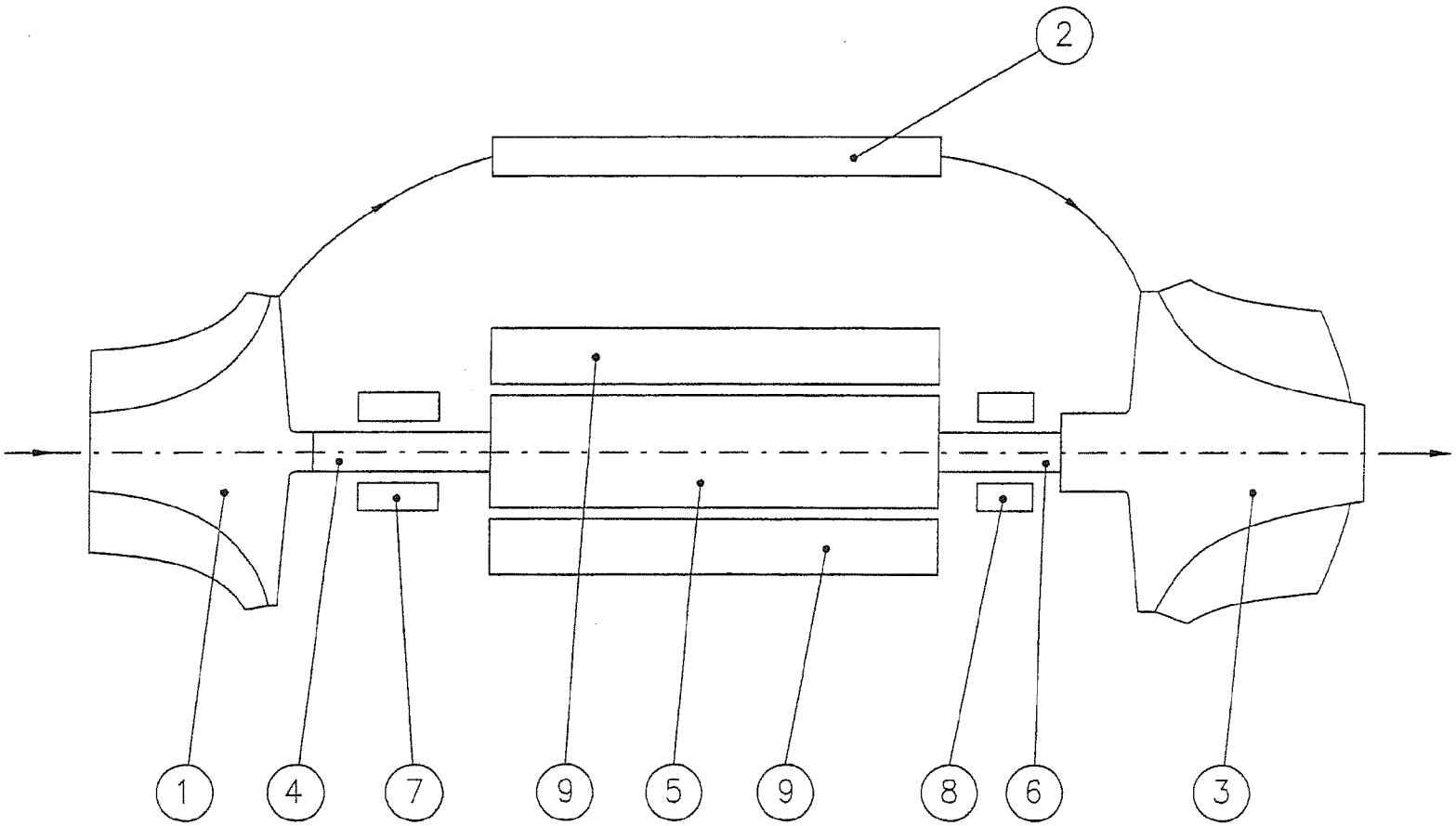
FIG. 1*a* is a schematic view of a single generator stage turbomachinery electric generator arrangement in accordance with the invention.
Figure 1B:
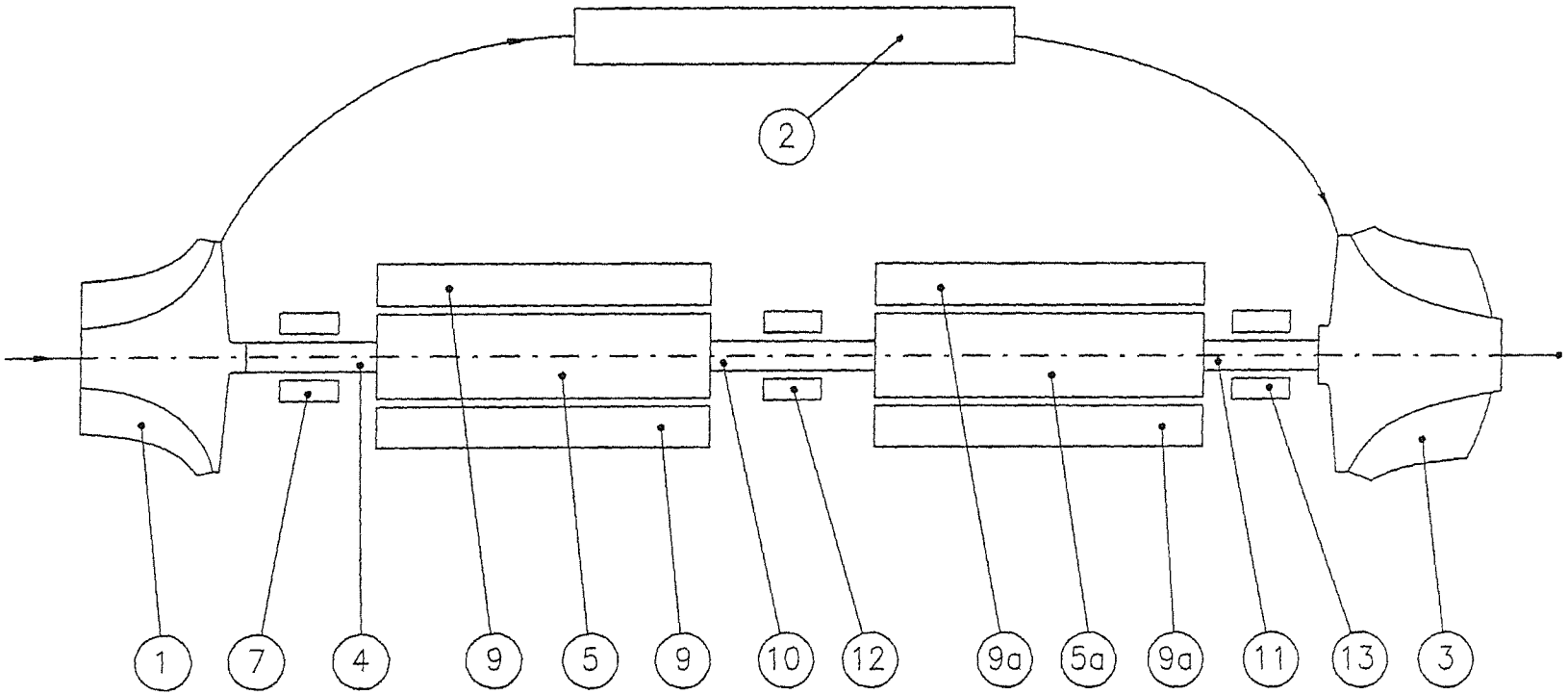
FIG. 1*b* is a schematic view of a double generator stage turbomachinery electric generator arrangement in accordance with the invention.

Referring to the drawings, illustrated diagrammatically in FIG. 1A and 1B. Item 1 of FIG. 1A is the centrifugal compressor that supplies compressed air to the combustion chamber or combustion chambers 2 that deliver the products of combustion to the radial inward flow turbine 3.

The impellers of the compressor and of the turbine are overhung at the ends of the rotor 4, 5, 6 that runs in the bearings 7 and 8 one of which includes a thrust/surge bearing. Item 5 is the permanent magnet armature of the high-speed generator, and 9 is the stator of the generator in which current is induced by the rotation of the armature. The current passes to an inverter (not indicated) that converts to the voltage and frequency required by the load, the electrical energy supplied to it from the stator.

The compressed air from the compressor passes, as is known in the art, to a combustion chamber or chambers where fuel is burnt to form the high temperature products of combustion that are passed to the turbine, and are expanded on passage through the turbine. (As is known in the art in cycles in which the exhaust temperature of the turbine sufficiently exceeds the temperature of the air delivered by the compressor then using some of the heat of the exhaust will increase the efficiency of the cycle. Before it enters the combustion chamber(s) the temperature of the air from the compressor is raised by heat exchange with the exhaust gases. A heat exchanger of that kind is not indicated in FIG. 1, but may be provided in appropriate thermodynamic and economic circumstances.)

When running above a threshold speed, its self-sustaining speed, the turbine generates sufficient power to drive the compressor, and at speeds above the self-sustaining speed, and with the necessary increase in the flow of fuel, the turbine generates the additional power that is required as the generator is loaded. The turbine is run-up to its self-sustaining speed by using the generator in its motor mode in which it takes electrical energy temporarily, via the inverter, from a battery or other supply.

Another arrangement is illustrated diagrammatically in FIG. 1B. Two generators of the same rating or of different ratings are now close coupled in tandem but, except for such changes in detail as may be required by the increased power demand, the compressor, the turbine and the combustion chamber or combustion chambers remain the same. The rotor 4, 5, 10, 5*a*, 11 runs on the three bearings 7, 12, 13 one of which includes a thrust/surge bearing.

According to the invention units are to be assembled from a number of modules standardised in design although they will sometimes differ in their dimensions, and in the instance of the rotors they will have different ends in dependence upon their application.

Figure 2:
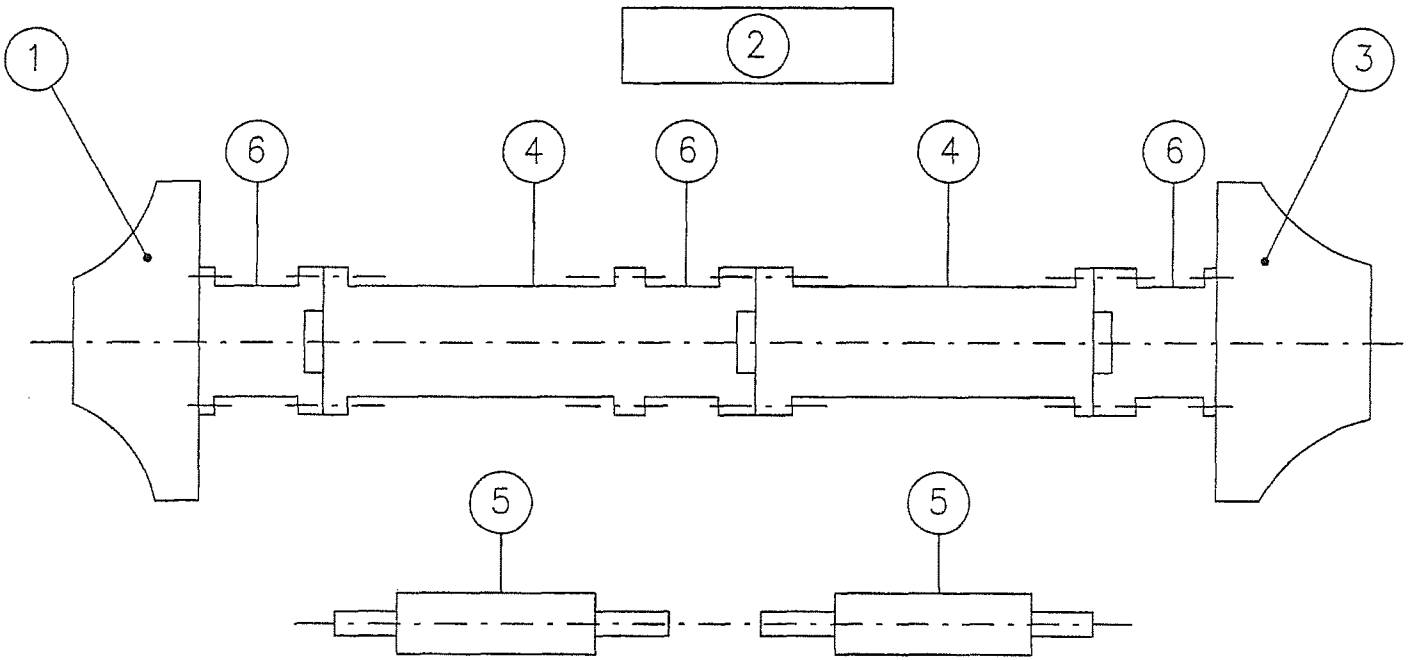
FIG. 2 is a schematic view of the modular nature of construction of the arrangement of FIG. 1*b*; and, FIGS. 3 to 10 are detailed views of components and modules comprising a turbomachinery electric generator arrangement in accordance with the invention.

The modules of FIG. 1B include the lesser number of modules of FIG. 1A and it is sufficient to provide diagrammatic illustrations of the modules of FIG. 1B. The modules of FIG. 1B are illustrated in FIG. 2 in which the central figure illustrates the casings of its modules. (Although the numbering of FIG. 2 partly follows that of FIG. 1, the designations of the two sets of numbers are not identical.)

Item 1 of FIG. 2 is the compressor module, 2 is the combustion chamber module, 3 is the turbine module, 4 is the generator module, and 6 is the bearing spacer module. The armatures of the generator modules are illustrated at 5. The modules 1, 6, 4 and 3 are flanged and are illustrated bolted together in the sequence 1, 6, 4, 6, 4, 6, 3.

With the exception of combustion chamber module 2, in the figure (the construction of which is well known in the art), the preferred construction of the modules will now be described in detail. However the description will be prefaced by referring to two design problems. The first is the removal of heat from the armature of a rotor. Although ideally no eddy currents are induced in an armature there are harmonics that generate eddy currents present in the field in which the armature rotates. The heat produced by the eddy currents has to be removed. The second is that the bearing module 7 in proximity to the turbine has to be protected from the heat of the turbine.

Compressor

Figure 3:
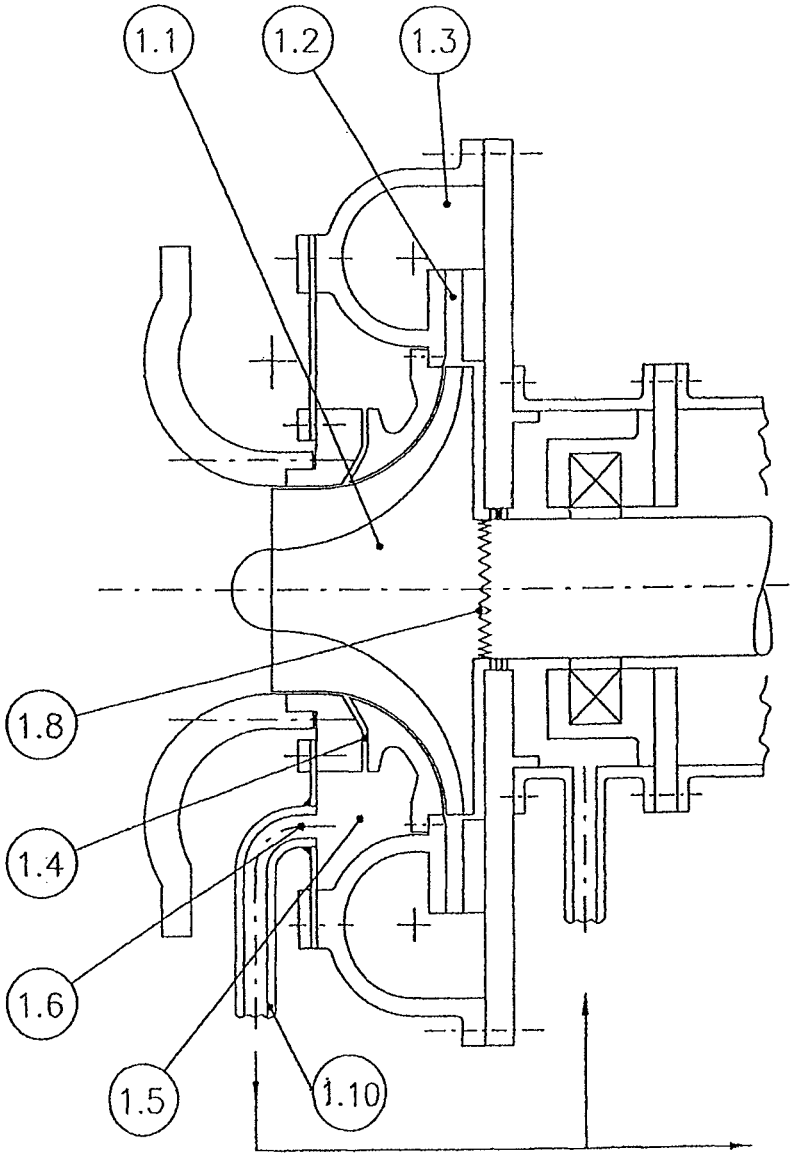

A preferred construction of the compressor module is illustrated in FIG. 3 in which 1.1 is the impeller of the compressor, 1.2 is a second vaneless space of the principal output of the compressor and 1.3 is a second volute. The compressor has a subsidiary first vaneless space at 1.4 and a first volute 1.5. The vaneless space is bridged (not illustrated) at three or more points near its outer periphery to hold the outer part of the compressor casing rigid by to its principal member.

The purpose of this secondary provision is to tap a supply of air at the lower pressure required for the cooling, noted above, of the armatures. (it is inefficient to draw the cooling air from the higher pressure of the principal output, as the greater work required producing that air is wasted, and becomes unwanted heat on throttling to the pressure required for cooling.) The flexible panel 1.6 closes the secondary volute and carries the outlet 1.10 of the lower pressure air. The panel is flexible to accommodate small errors in the alignment of its abutments, and the outlet feeds cooling air to the bearing spacers shown as number 6 in FIG. 2 that are adjacent respectively to the compressor and to the turbine. The central bearing spacer 6 of FIG. 2 is open to atmosphere so that cooling air flows inwardly to the central bearing spacer from the bearing spacers adjacent respectively to the compressor and to the turbine. When there is only one generator as in FIG. 1, the preferred path for the cooling air is to the bearing spacer adjacent to the turbine, and then to be exhausted to atmosphere at the bearing spacer adjacent to the compressor.

The impeller of the compressor is driven by, and held co-axial with its rotor by the toothed coupling (e.g. a Hirth coupling) indicated at 1.8. The impeller is held to its rotor by an axial tie-bolt that is not indicated in the figure. It is preferred that the rotor seal indicated at 1.9 should bear upon the rotor rather than upon an extension from the back of the impeller because the seal is then unaffected by any error in the alignment of the impeller with the rotor.

Bearing Spacer Module

Figure 4:
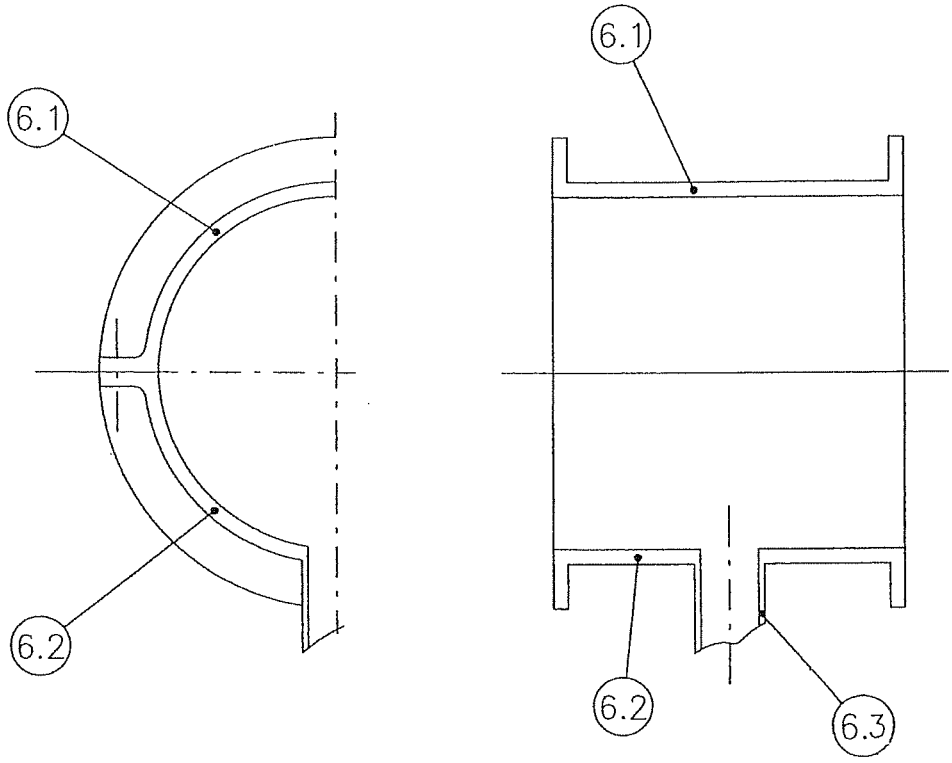

The bearing spacer module illustrated in FIG. 4 has two substantially equal halves as is indicated in the figure at 6.1 and at 6.2. The lower half of the spacer module, item 6.2 has a pipe connection item 6.3 either to the subsidiary cooling air from the compressor (indicated at 1.6 in FIG. 3) or is open to atmosphere.

The bearing spacer module contains the bearing housing module with its bearing. The upper half of a spacer may be removed without upsetting the rotor and its bearings for inspection of a bearing and to facilitate the fitting by way of the bearing an accelerometer for the measurement of vibration and a thermocouple to measure bearing temperature. The accelerometer and thermocouple provide valuable data on commissioning of a unit and subsequently contribute to health monitoring in service.

Bearing Housing Module

Figure 5:
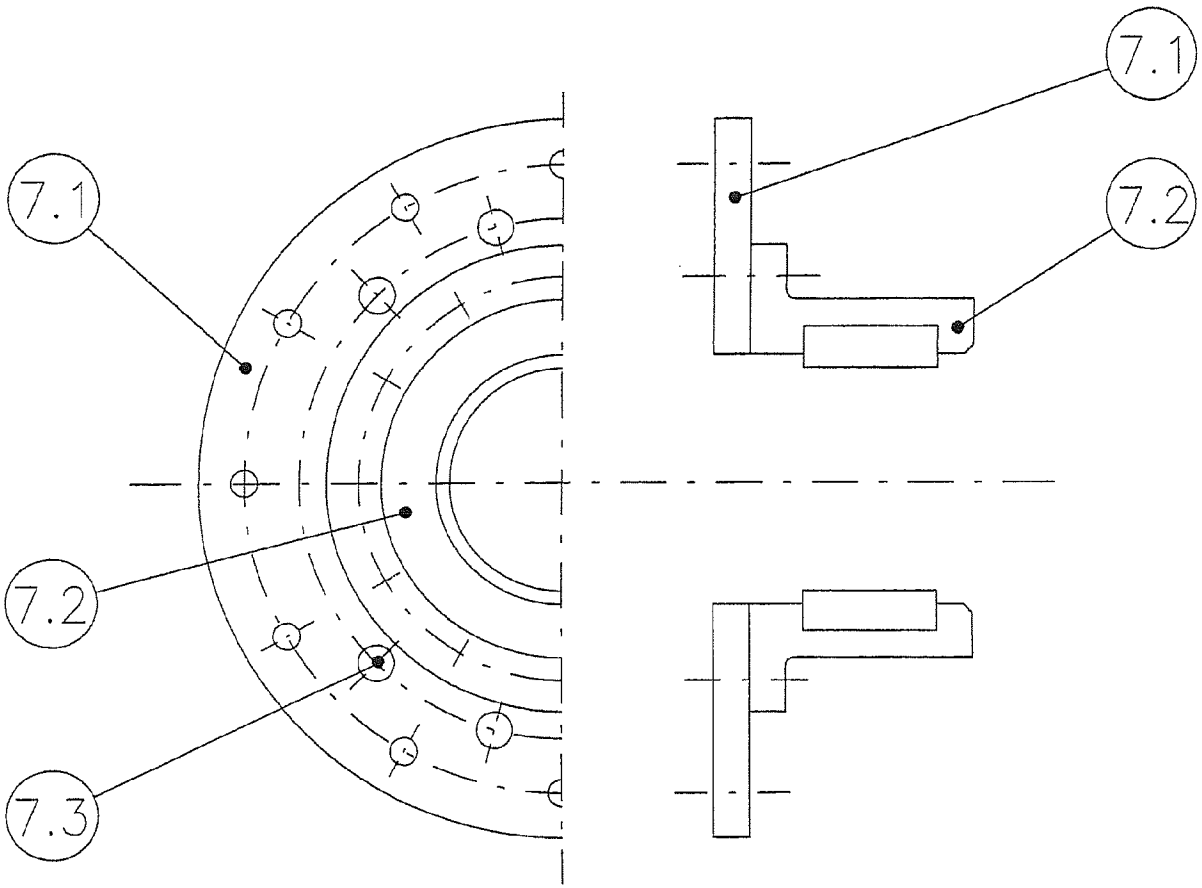

The bearing housing module is illustrated in FIG. 5 and comprises a bulkhead panel 7.1 that carries the bearing housing and bearing 7.2. As is indicated in FIG. 2, a bearing housing module is clamped between a flange of a bearing spacer module and a flange of a generator stator module.

The bearing module, and its bearing, must be split (most conveniently diametrically) to permit assembly of the bearing if the bore of the bearing is too small for the bearing to be assembled to its rotor axially. In general this requirement implies that slider bearing such as tilting pad bearings that benefit from small diameter journals will require split bearing modules whereas rolling element bearings that do not require seats of such small diameter may be contained in unsplit bearing housings.

A consideration of critical speeds in the first bending mode lends advantage to the use of rolling element bearings. Rolling element bearings do not require a necking of the rotor close to the overhung impellers. Necking reduces the first bending critical speed and makes it more difficult, if not impossible, to design so that the first bending mode critical lies above running speed.

The through holes, 7.3 in the bulkhead, are for the passage of cooling air in to or from the air gap of the generator.

Generator Stator Module

Figure 6:
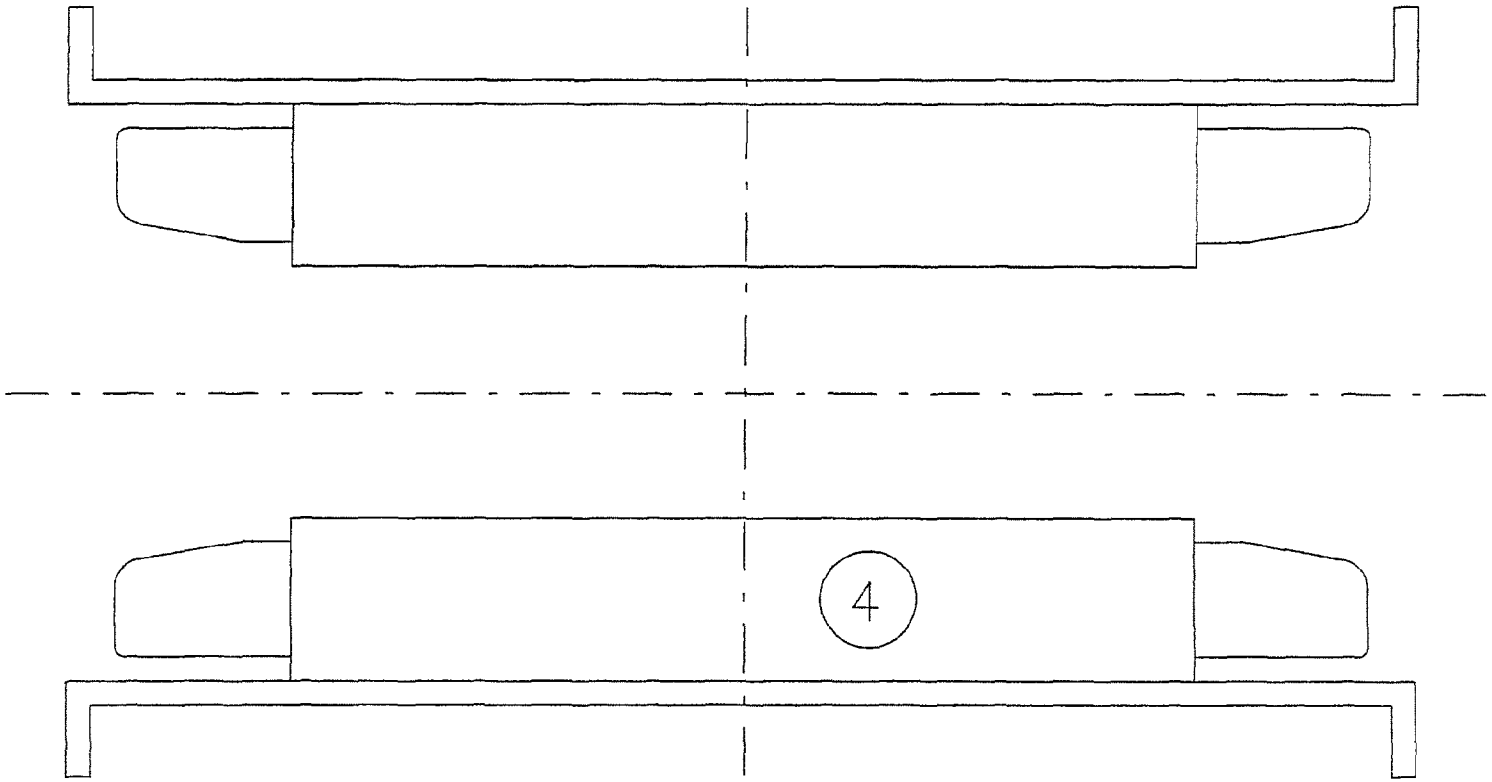

A generator stator module is illustrated in FIG. 6. In the context of this invention its feature of significance is the flanging of its unsplit casing. This flanging is necessary for the assembly to it of bearing spacer modules as is indicated in FIG. 2 by items 4 and 6.

Turbine Module

Figure 7:
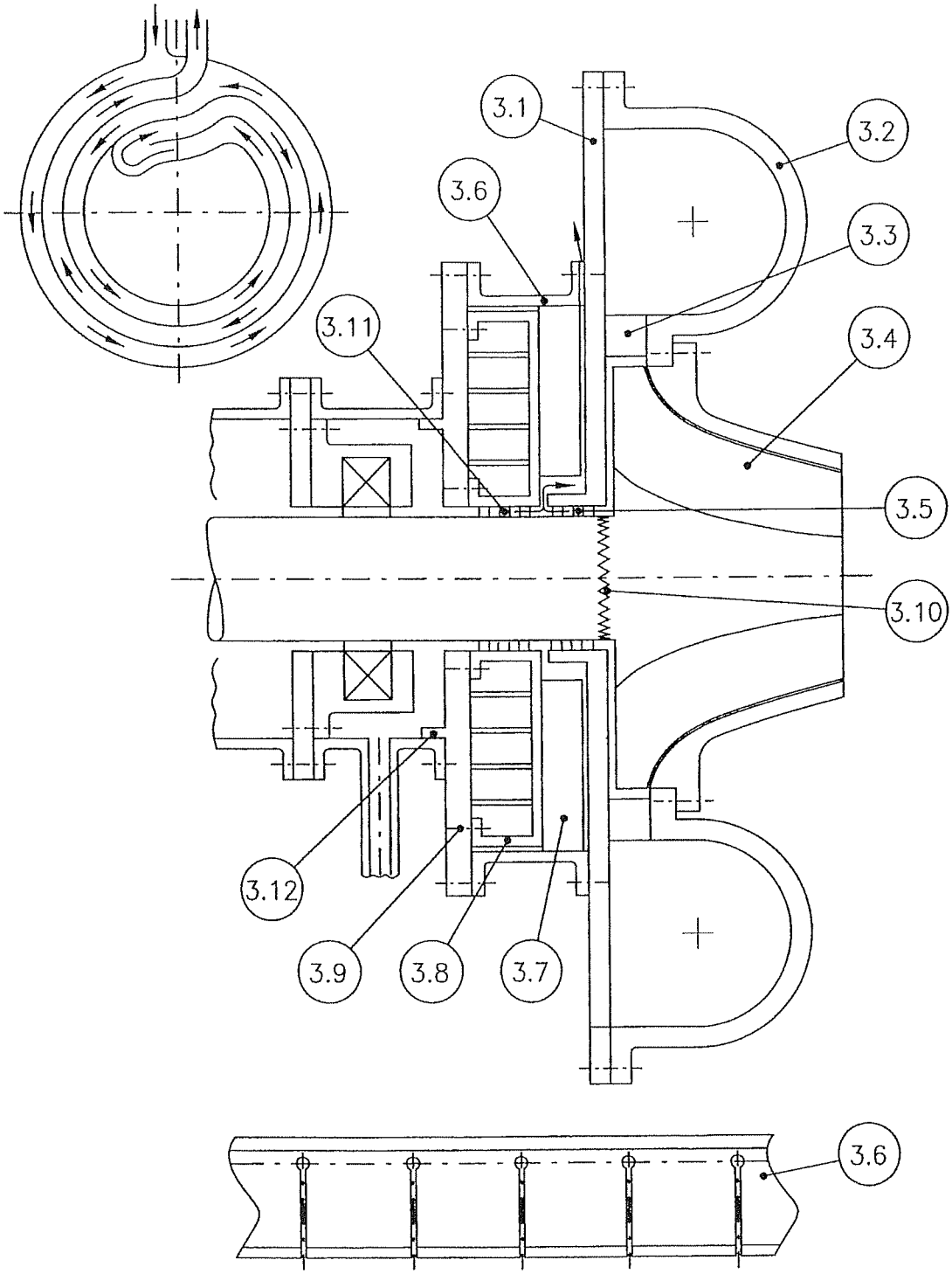

The turbine module follows the conventional design of inward flow turbines with the exception of the provisions made with relation to the second design problem that has been noted already—to protect the turbine-end bearing from the heat of the turbine. A preferred construction of the turbine module is illustrated in FIG. 7. In the FIG. 3.1 is the backing plate on which the casing of the turbine is mounted, 3.2 is the inlet belt of the turbine, 3.3 are its inlet guide vanes, 3.4 is its impeller, and 3.5 is a rotor seal mounted from the backing plate 3.1. Item 3.6 is a flanged ring with a split skirt as indicated at the bottom of the figure. It is split to accommodate the differential thermal expansion between its attachment to the hot turbine backing plate and the cooled plate 3.9. Item 3.7 is an annulus of ceramic insulation held by the ring 3.6 and with a gap at its inner radius and between its RH face and the backing plate 3.1. Item 3.8 is a water-cooled annulus bolted to the plate 3.9 and bearing a rotor seal 3.11 at its inner radius. The water-cooled annulus contains a two-start spiral baffle as indicated in the inset figure at the top LH of the figure. The water inlet and outlet are adjacent, but the spirals force the water to spiral towards the inner radius of the annulus and then to spiral outwards. The effect of the spiral is to produce a substantially constant temperature over the face of plate 3.9.

The turbine module is attached to its bearing spacer module by the plate 3.9 that is centred by the spigot 3.12. The impeller of the turbine is held to the rotor by the claw coupling and tie-bolt means as has been described already for holding the compressor impeller. The claw or Hirth coupling is indicated at 3.10.

Rotor Module

The eddy currents that heat the armature of a rotor have been described already. The heat of the eddy currents is carried away in cooling air flowing in two paths. One path is the air gap between the outer surface of the armature and the bore of the stator. The second path is available because a rotor has the aspect of a thick walled tube. Cooling air passes in to the bore of the tube by radial holes at one end of a rotor. It passes to exhaust holes at the other end by the gap formed between the bore of the tube and a concentric cylindrical insert that forces the cooling air to wash the bore of the tube.

Figure 8:
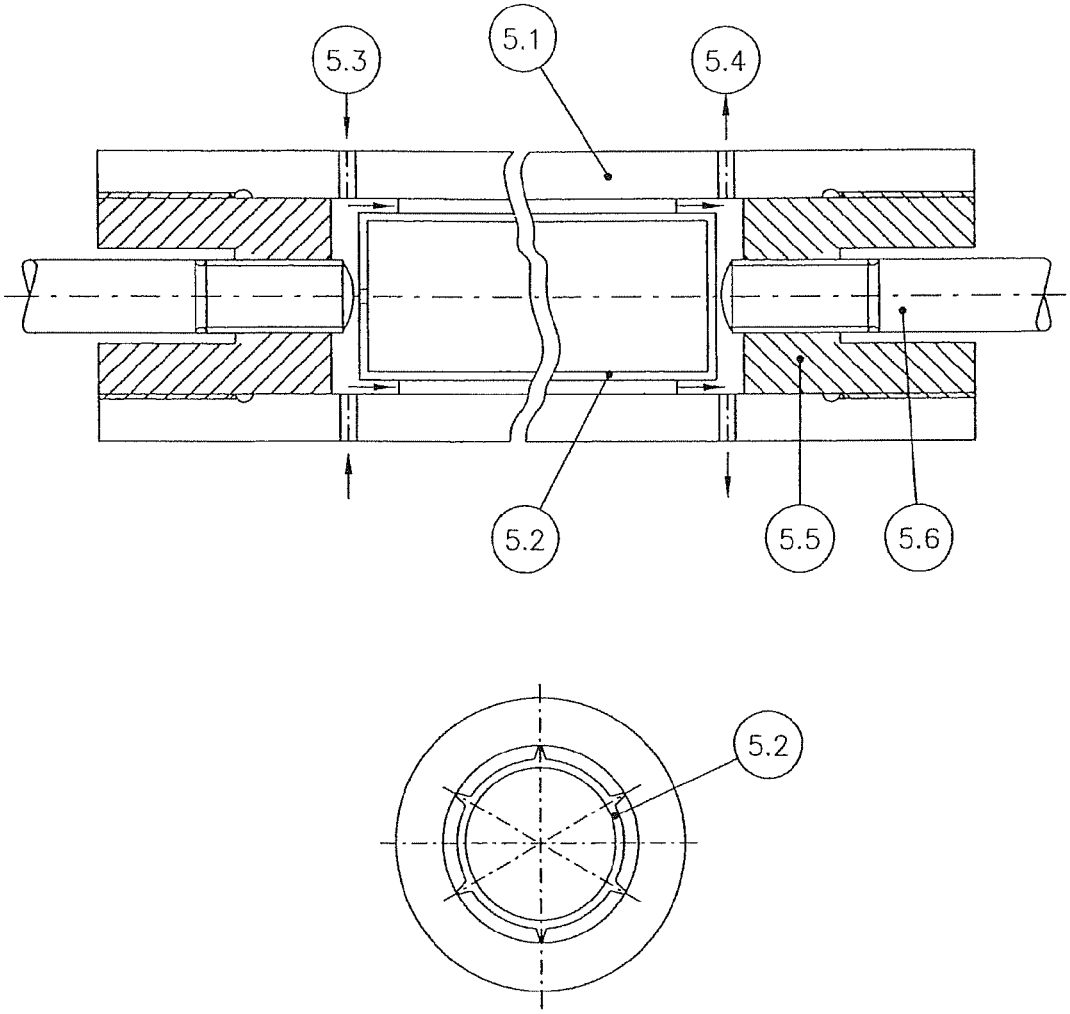

A rotor module is illustrated in FIG. 8. It is shown diagrammatically, and the permanent magnets of the armature and their attachment to the rotor are not shown.

The diagram shows the thick walled tube 5.1 that represents the rotor with a concentric cylindrical insert 5.2 and radial holes 5.3 and 5.4 respectively for the inward and outward flow of cooling air. To minimise any eddy current heating in the insert itself it is a thin walled tube of stainless steel or other material of high resistivity held concentrically in the bore of the rotor by the upstands indicated in the inset at the bottom of the figure. The insert is sprung in to the bore. It forces the cooling air to wash the bore of the rotor, and thereby, with other factors taken into consideration such as pressure drop, velocity and mass flow, to optimise the heat carried away by the cooling air.

The concentric insert is possible only if the bore of a rotor is initially unobstructed. That is achieved by internally screw-cutting a thread at the ends of the uniform bore of a rotor, and fitting screwed end-plugs that in turn are bored and screwed for the tie bolts to hold the impellers, and to close couple two rotors. An end plug is indicated at 5.5 of FIG. 8 and a tie-bolt at 5.6.

Figure 9A:
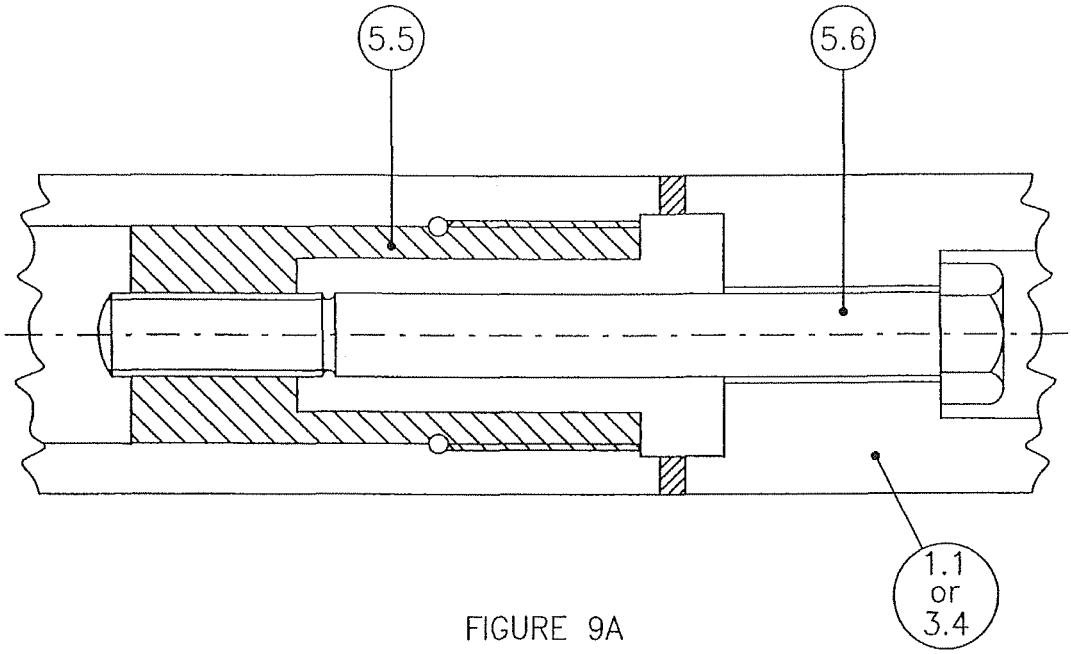

FIG. 9A illustrates the attachment to an armature of either the impeller of the compressor (1.1) or the impeller of the turbine (3.4). The end plug is counter bored to lengthen the tie bolt 5.6 and thereby to give it some axial flexibility so that its tightening force will vary less with differential expansion of tie bolt and impeller.

Figure 9B:
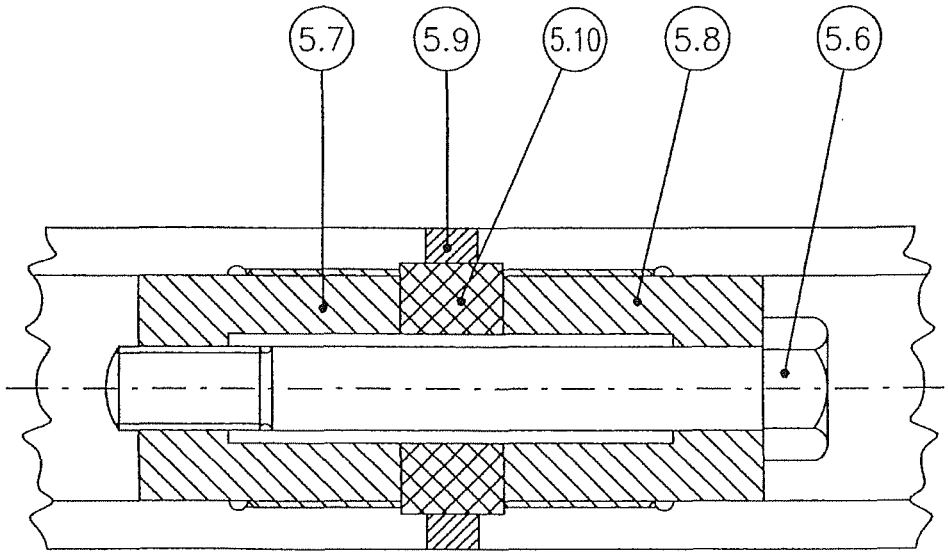

FIG. 9B illustrates the close coupling of two armatures in tandem. The end plugs of the armatures are respectively items 5.7 and 5.8. The tie bolt 5.6 is screwed in to item 5.7 and holds together the claw or Hirth coupling 5.9. Item 5.10 is a hollow cylinder that is a press fit in the counter bores in each armature by way of the coupling and serves to hold the ends of the armatures concentric one with another.

Figure 9C:
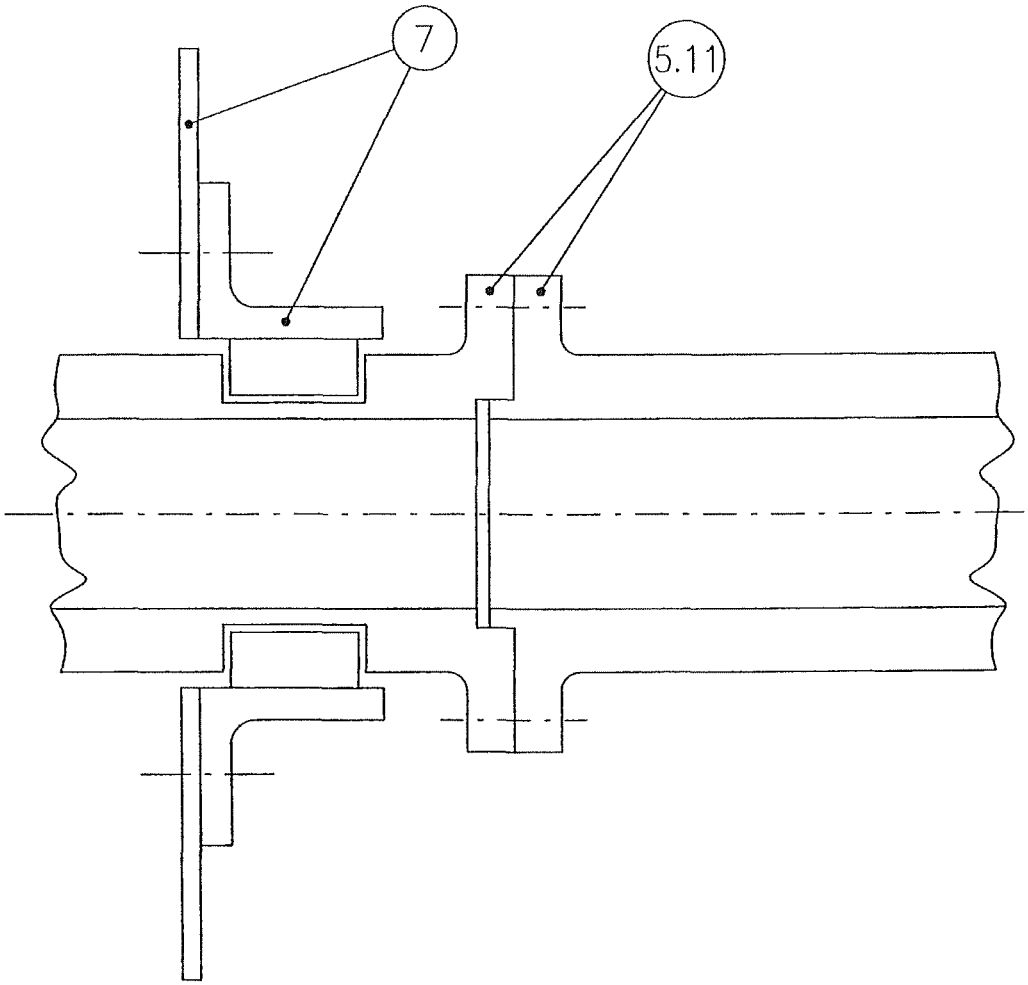

FIG. 9C illustrates the close coupling in tandem of two armatures when the central bearing (12 in FIG. 1B) is a split slider bearing held in a bearing housing module which is also split. The split bearing and split housing allow the rotors to be coupled by spigot and flange. In the Figure, item 7 indicates the split bearing housing and 5.11 the flanged coupling.

Flows of Cooling Air

Figure 10:
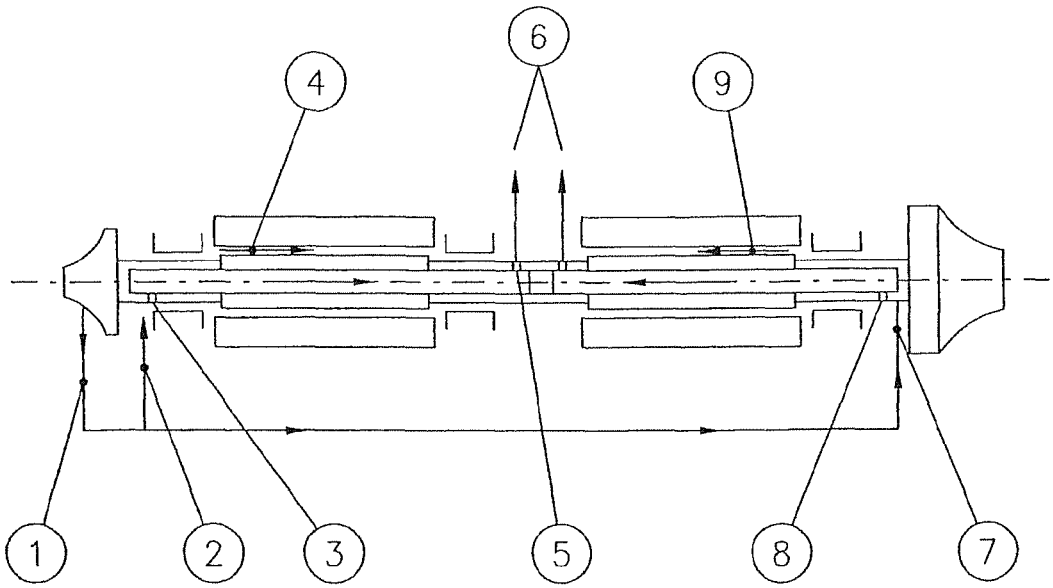

The preferred flows of cooling air for a unit with two armatures in tandem is illustrated diagrammatically in FIG. 10. In the Figure, item 1 is the flow of cooling air from the compressor (item 1.10 of FIG. 3) to 2 and 7 which are respectively the inflows to the bearing spacers of FIG. 3 and FIG. 7. The radial holes giving access for the flow of air to the bores of the armatures are 3 and 8 respectively between the shaft seal 1.9 in FIG. 3 and the adjacent bearing, and between the two shaft seals 3.5 and 3.11 of FIG. 7. This positioning of holes cools the bearings before the air has received heat from other sources. With reference to FIG. 3, the shaft seal 1.9 whose primary duty is to contain the leakage of air from the compressor now contains also the cooling air. There is some balance of pressure across the seal that reduces the leakage flow.

With reference to FIG. 7, the shaft seal 3.11 contains the leakage of cooling air and the shaft seal 3.5 contains the leakage of high temperature gas from the turbine. Both leakages escape to atmosphere via the large clearance at its inner radius of the ceramic insulator 3.7, and the space between its front face and the backing plate 3.1. The final escape is via the slots in item 3.6, or some other hole.

The flows of air 2 and 7 also pass partly through the air gaps of the generators as indicated at 4 and 9 in FIG. 10. The flows enter the air gaps via holes such as 7.3 in FIG. 5.

The air flowing through the bores of the armatures escapes to atmosphere via radial holes in the armatures as indicated at 6 in FIG. 10. The final escape of this air, and also the air through the air gaps is from the opening in the lower half casing of the bearing spacer module, as indicated by item 6.3 of FIG. 4.

In the instance of a unit with one generator the cooling air from the compressor goes to the turbine end and enters the bore of the armature and the air gap in the same way as has been described above. The air passing outwardly through the radial hole proximate the compressor, and passing through the air gap, escapes to atmosphere via vents in the bearing spacer proximate the compressor.

There have been described and illustrated herein several embodiments of a turbomachinery electric generator arrangement. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

The invention claimed is:

1. A turbomachinery electric generator arrangement, comprising:

a rotary compressor having an impeller arranged to compress gas through a primary gas outlet to a first volute of the compressor arranged around the impeller;

a rotary armature and a stator, the stator outputting electrical energy induced by rotation of the rotary armature;

a combustion chamber to which compressed gas is directed from the first volute of the compressor;

a rotary turbine to which combustion product is directed from the combustion chamber; and a bearing arrangement supporting in rotation the rotary compressor, the rotary armature, and the rotary turbine;

wherein the rotary compressor has a secondary outlet that produces cooling gas separate from the compressed gas supplied to the combustion chamber, wherein the cooling gas is directed from the secondary outlet to the rotary armature by a cooling path around an outer edge of the first volute of the compressor and to the rotary armature such that the cooling gas flows past the rotary armature for cooling the rotary armature, and wherein the cooling gas directed from the rotary compressor to the rotary armature is at a pressure lower than that of the compressed gas supplied by the rotary compressor to the combustion chamber.

2. The turbomachinery electric generator arrangement according to claim 1, wherein the secondary outlet that produces the cooling gas includes a first vaneless space disposed both adjacent the impeller and upstream of the primary outlet.

3. The turbomachinery electric generator arrangement according to claim 2, wherein the secondary outlet that produces the cooling gas further includes a second volute disposed downstream of the first vaneless space.

4. The turbomachinery electric generator arrangement according to claim 2, wherein the primary outlet that produces the compressed gas includes a second vaneless space disposed both adjacent the impeller and downstream of the first vaneless space.

5. The turbomachinery electric generator arrangement according to claim 4, wherein the primary outlet that produces the compressed gas further includes the first volute disposed downstream of the second vaneless space.

6. The turbomachinery electric generator arrangement according to claim 1, wherein the cooling path directs the cooling gas produced by the secondary outlet of the rotary compressor such that the cooling gas flows past bearings of both the rotary compressor and the generator arrangement for cooling the bearings.

* * * * *